US008784164B2

(12) United States Patent
Dai

(10) Patent No.: US 8,784,164 B2
(45) Date of Patent: Jul. 22, 2014

(54) POWER TOOL WITH A SHIELD

(75) Inventor: Youjun Dai, Nanjing (CN)

(73) Assignee: Chervon (HK) Limited, Hong Kong (HK)

( * ) Notice: Subject to any disclaimer, the term of this patent is extended or adjusted under 35 U.S.C. 154(b) by 748 days.

(21) Appl. No.: 13/015,796

(22) Filed: Jan. 28, 2011

(65) Prior Publication Data

US 2011/0195643 A1 Aug. 11, 2011

(30) Foreign Application Priority Data

Feb. 9, 2010 (CN) ..... 2010 2 0114863

(51) Int. Cl.
*B24B 27/08* (2006.01)
*B24B 55/05* (2006.01)

(52) U.S. Cl.
USPC ..... 451/451; 451/359; 451/452; 451/455

(58) Field of Classification Search
USPC ..... 144/252.1; 451/354, 356, 357, 358, 451/359, 451, 452, 455, 456, 457
See application file for complete search history.

(56) References Cited

U.S. PATENT DOCUMENTS

| | | | | |
|---|---|---|---|---|
| 6,561,063 | B1 * | 5/2003 | Mulford et al. | 82/128 |
| 7,063,606 | B2 | 6/2006 | Stierle et al. | |
| 7,892,075 | B2 * | 2/2011 | Esenwein | 451/451 |
| 8,454,412 | B2 * | 6/2013 | Esenwein | 451/359 |
| 2009/0029635 | A1 * | 1/2009 | Boeck et al. | 451/359 |
| 2009/0209184 | A1 * | 8/2009 | Esenwein | 451/451 |
| 2010/0178857 | A1 * | 7/2010 | Esenwein | 451/359 |

FOREIGN PATENT DOCUMENTS

CN 101293330 A 10/2008

* cited by examiner

*Primary Examiner* — Timothy V Eley
(74) *Attorney, Agent, or Firm* — Greenberg Traurig, LLP

(57) ABSTRACT

A power tool includes a housing accommodating a motor therein, a bearing base having a lower surface and an upper end that is connected to the housing, an output shaft that is mounted in the bearing base and protrudes out of the lower surface of the bearing base, a shield that is movably connected with the bearing base, and a locking mechanism for locking the shield relative to the bearing base. The locking mechanism further includes a locking element arranged on the shield and a stop member and the bearing base is formed with a hollow chamber within which the stop member is arranged.

6 Claims, 9 Drawing Sheets

POWER TOOL WITH A SHIELD

RELATED APPLICATION

This application claims the benefit of CN 201020114863.9, filed on Feb. 9, 2010, the disclosure of which is incorporated herein by reference in its entirety.

BACKGROUND

The subject disclosure generally relates to power tool and, more particularly, to a power tool with a shield.

Power tools with a shield generally comprise angle grinders, rotary sanders and so on. In operation, the operator needs to adjust the angle position of the shield, if necessary, so as to relocate the shield for protection.

At present, the locking mechanism that is common in the market is a cam locking mechanism. Such cam locking mechanism is adapted to be used in the power tool with a movable collar; that is, a cam member is arranged on the collar of the shield. When the shield is mounted to the body, the cam member is moved by the operator to force the collar to be contracted so as to lock the shield. When the angle of the shield needs to be adjusted, the cam member is moved to release the contracted collar, and now the shield may be rotated relative to the body so as to be adjusted and positioned in a new work angle. However, the safety of such mechanism is relative low.

U.S. Pat. No. 7,063,606 discloses a rotating lever which is arranged on the body and has a projection thereon. In the natural state, the rotating lever may be locked within the locking groove of the shield by means of the force of a spring. If the operator pulls and rotates the rotating lever, the projection on the lever may disengage from the locking groove on the shield so as to rotate and then the shield is adjusted. In such mechanism, since the rotation lever is arranged on the body, the structure of the body is complicated and the mechanism cannot be operated simply.

Chinese Patent Publication No. CN 101,293,330A discloses a stop member which is arranged on the side wall of a bearing base. In the natural state, the stop member may be locked within the locking groove of the shield by the force of a spring. If the stop member is moved by the operator, the stop member may disengage from the locking groove of the shield so that the shield can be rotated and adjusted. Since the stop member of such mechanism is mounted on the side wall of the bearing base, on one hand, the dimension of the bearing base is increased and the structure is complicated; on the other hand, the mechanism cannot be operated simply.

SUMMARY

The following discloses a shield-clamping mechanism which is safe and has a simple structure, and may be operated simply. To this end, the power tool of the present invention comprises a housing accommodating a motor, a bearing base having a lower surface and an upper end that is connected to the housing, an output shaft which is mounted into the bearing base and protrudes out of the lower surface of the bearing base, a shield movably connected with the bearing base and a locking mechanism locking the shield in relation to the bearing base and comprising a locking element arranged on the shield, wherein the locking mechanism further includes a stop member, and the lower surface of the bearing base is formed with a hollow chamber in which the stop member is arranged.

Further, the stop member may be formed with a locking arm, and the locking element arranged on the shield may be a groove for engaging with the locking arm.

Further, an elastic component may be arranged between the stop member and the bearing base with its one end acting on the stop member and the other end acting on the bearing base.

Further, the elastic component may be a spring.

Further, the stop member and the bearing base may be provided with a magnet thereon respectively.

Further, a hollow chamber may be formed in the lower surface of the bearing base.

Further, the hollow chamber may be formed with a guiding surface, and a stop member may be formed with the guiding side surface and slidably mounted within the hollow chamber.

Further, a support spacer may be mounted to the lower surface of the bearing base.

Further, the stop member may be further formed with an operation arm.

Further, the bearing base may further comprise a side wall formed with a groove which communicates with the hollow chamber in the lower surface, and at least one of the operation arm and the locking arm passes through the groove of the side wall.

With the above structures, shield-clamping is achieved conveniently by the operator.

DETAILED DESCRIPTION

Figure 1:
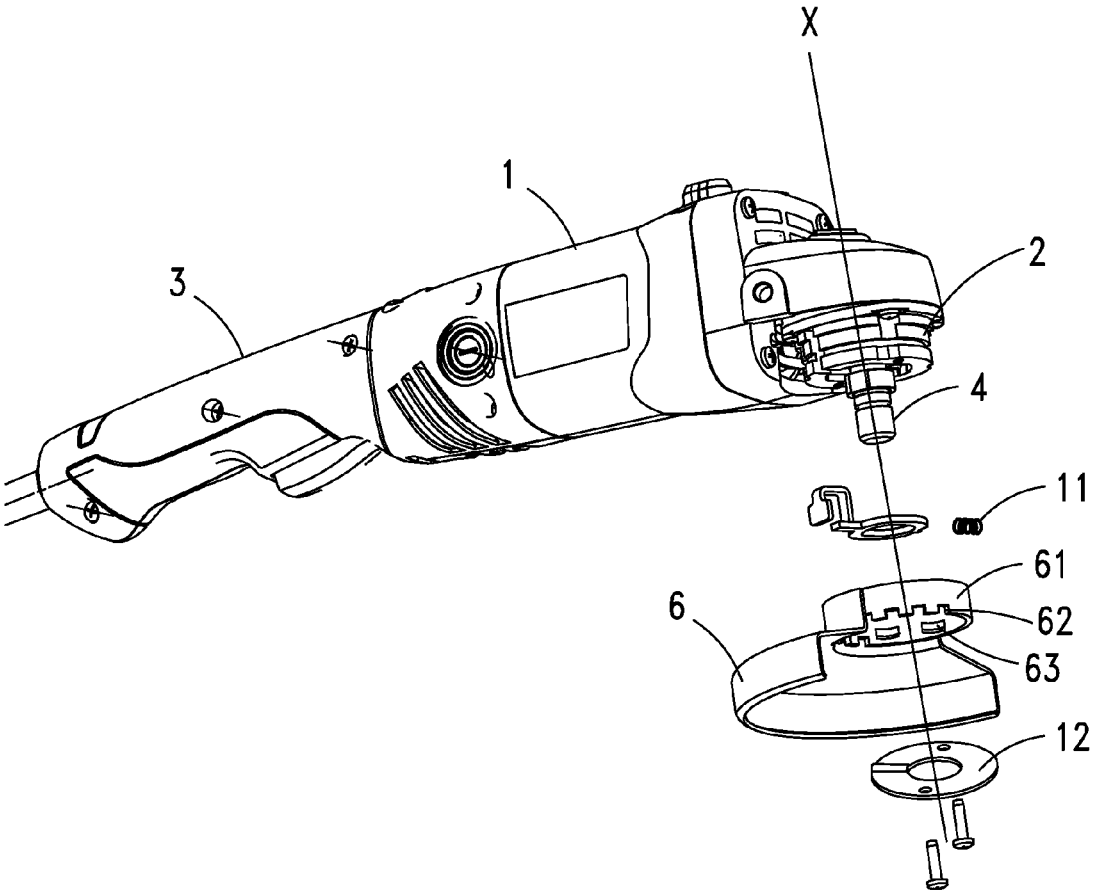
FIG. 1 is an exploded view of an exemplary shield-clamping device for a power tool according to the description that follows.
Figure 2:
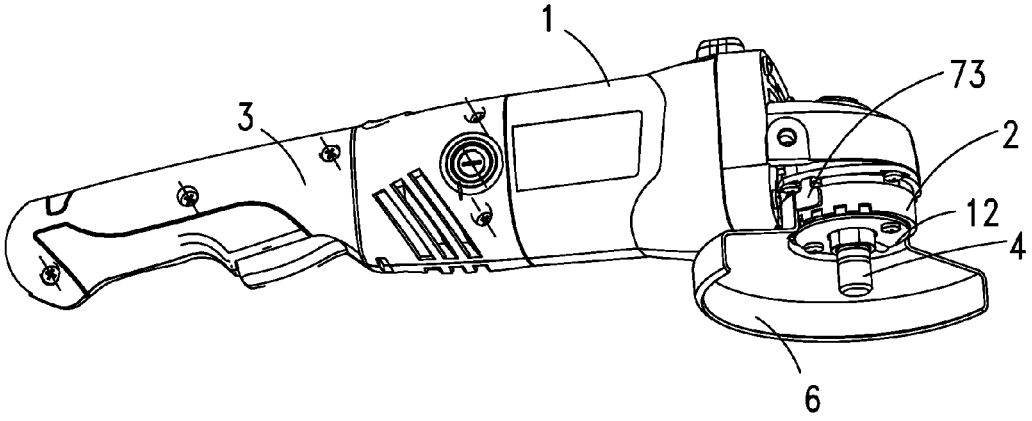
FIG. 2 is a perspective view of the shield-clamping device for a power tool, wherein the clamping device is in a clamped position.
Figure 3:
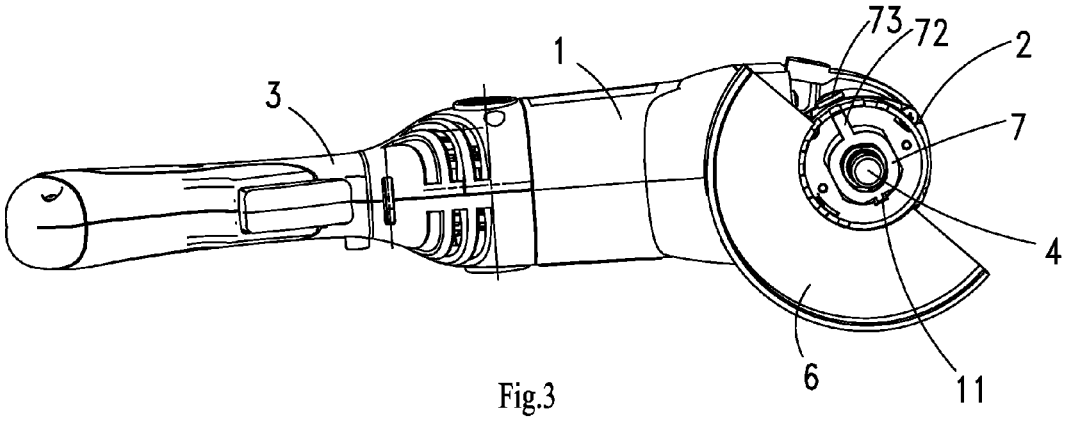
FIG. 3 is a perspective view of the shield-clamping device for a power tool, wherein the support spacer is removed and the clamping device is in a released position.
Figure 4:
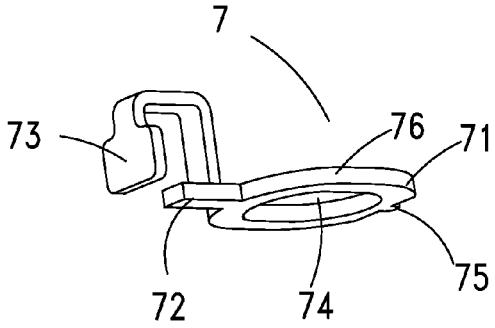
FIG. 4 is a perspective view of the stop member of the shield-clamping device for a power tool.
Figure 5:
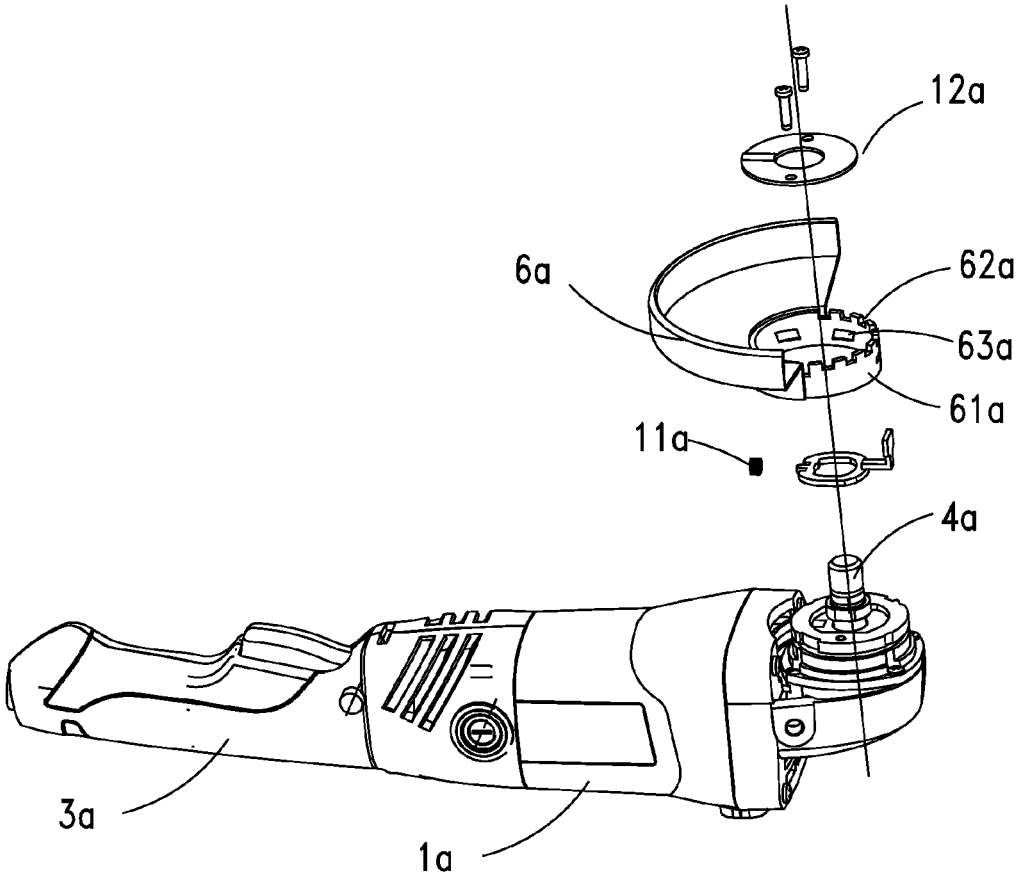
FIG. 5 is an exploded view of a second exemplary embodiment of a shield-clamping device for a power tool.
Figure 6:
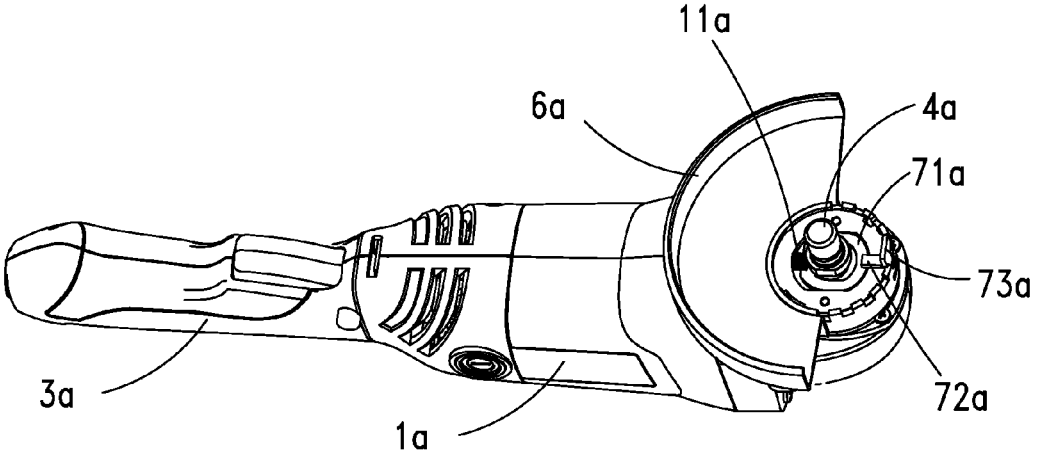
FIG. 6 is a perspective view of the shield-clamping device of FIG. 5, wherein the clamping device is in the clamped position.
Figure 7:
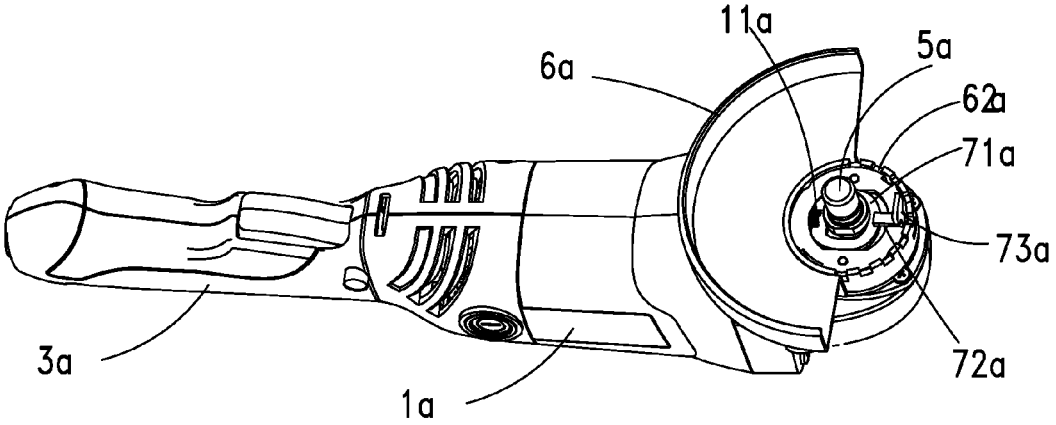
FIG. 7 is a perspective view of the shield-clamping device of FIG. 5, wherein the support spacer is removed and the clamping device is in the released position.
Figure 8:
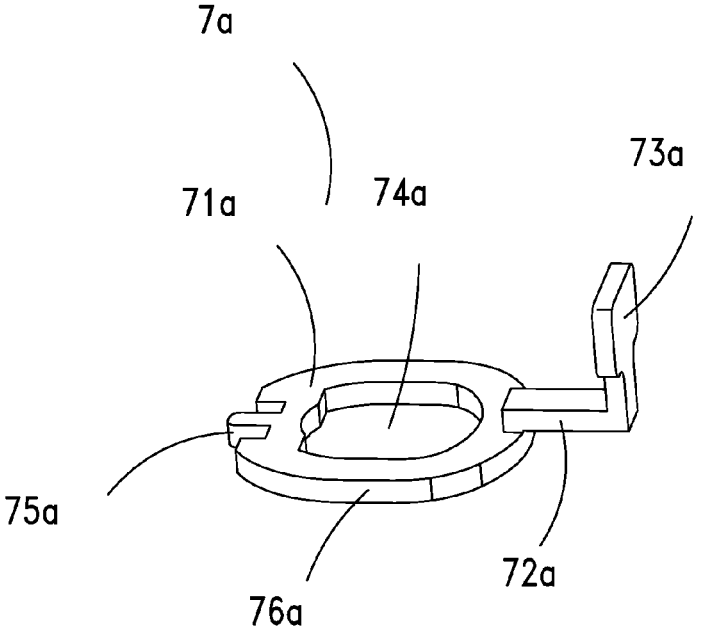
FIG. 8 is a perspective view of a second exemplary embodiment of a stop member of the shield-clamping device for a power tool.
Figure 9:
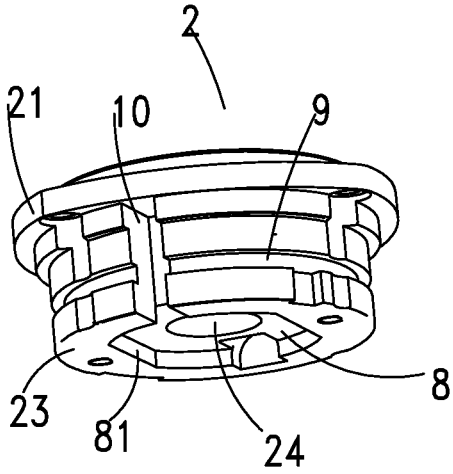
FIG. 9 is a perspective view of the bearing base of FIG. 1.
Figure 10:
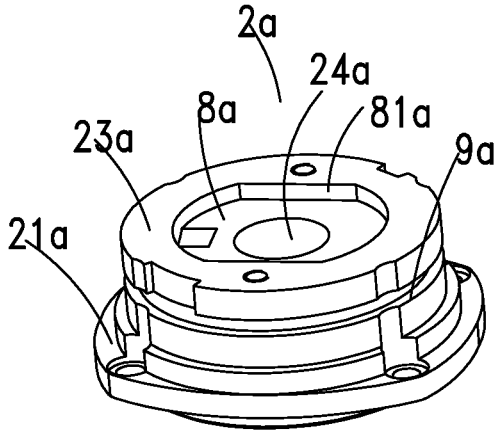
FIG. 10 is a perspective view of the bearing base of FIG. 5.
Figure 11:
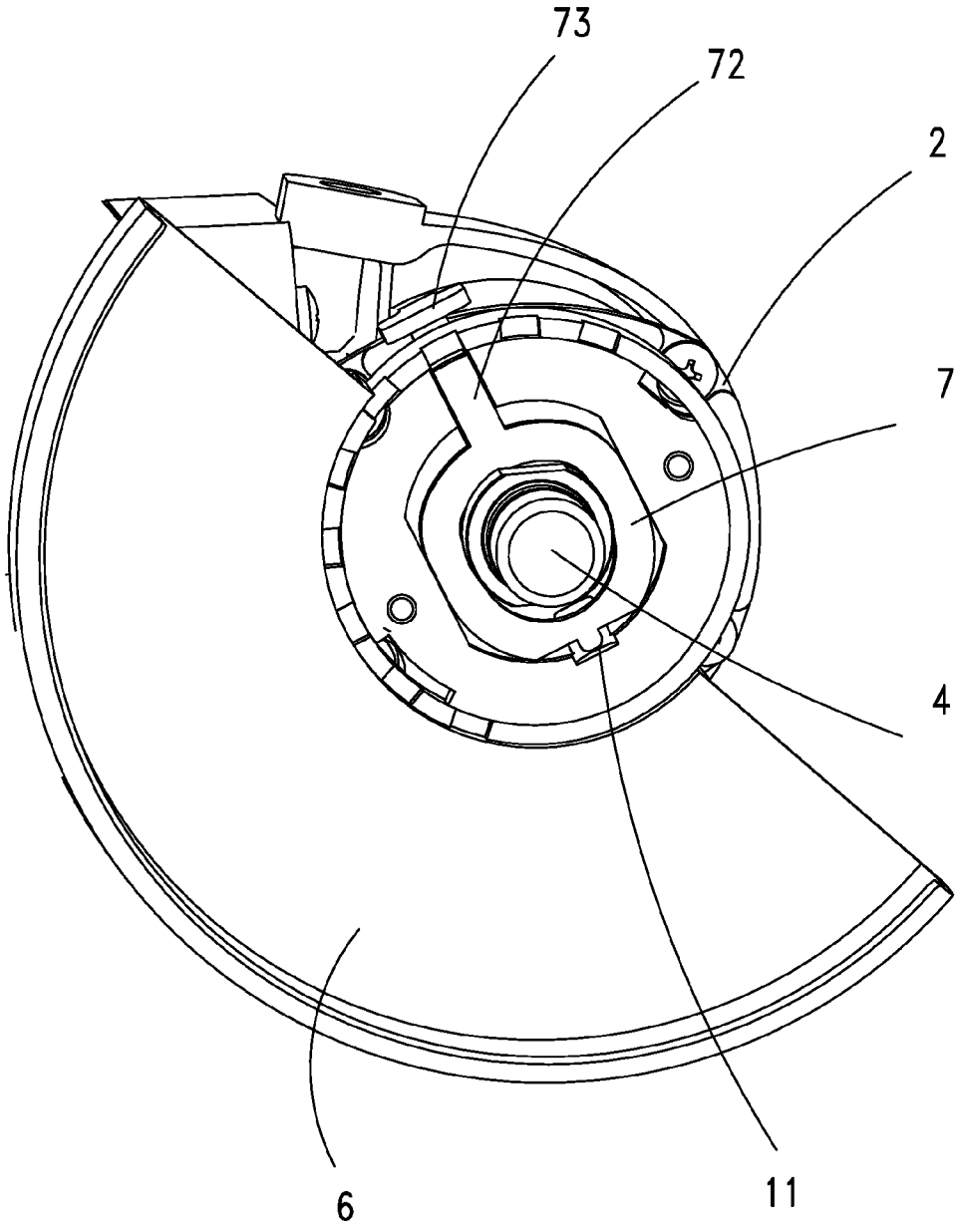
FIG. 11 is an enlarged view of the shield-clamping device of FIG. 3.
Figure 12:
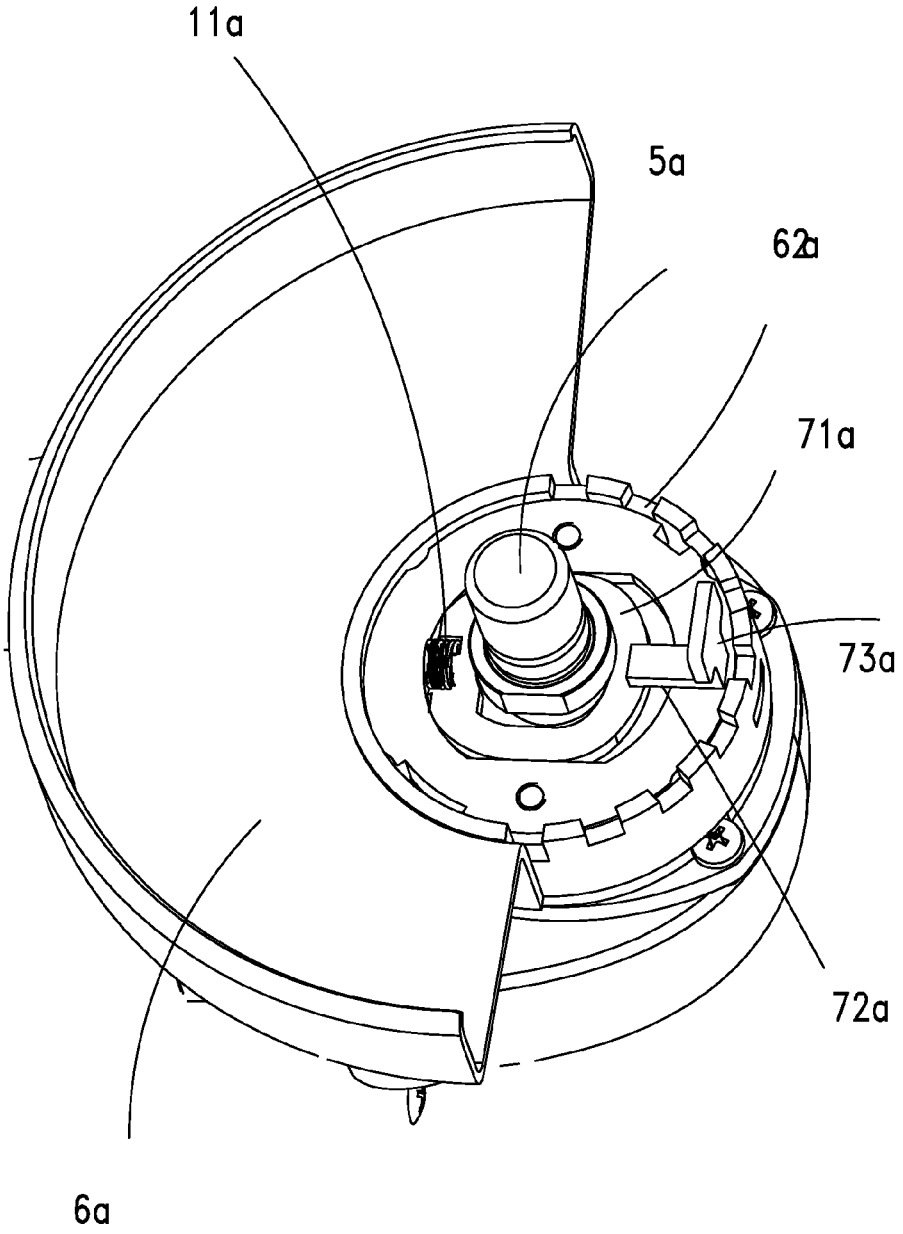
FIG. 12 is an enlarged view of the shield-clamping device of FIG. 7.

As shown in FIGS. 1, 2 and 3, the following relates to power tools and, more particularly, to a power tool such as an angle grinder, which comprises a housing 1 composed of a motor housing and a gearbox housing, a bearing base 2, a hand grip 3 mounted on one side of the housing 1, an output shaft 4 driven by a motor (not shown), a rotatable working head (not shown) mounted on the output shaft, and a shield 6 which is movably connected with the bearing base 2 and partly surrounds the working head for protection. The shield 6 has a collar or side wall portion 61 with multiple locking elements formed evenly around the axis line X of the output shaft 4. In the present embodiment, these locking elements are grooves 62. Further, multiple convex ribs 63 are formed on the inner side surface of the side wall 61.

As shown in FIGS. 1, 4, 9 and 11, the bearing base 2 is generally cylinder shaped, and is fixedly connected at its upper end to the bottom of the housing 1 by screws. The bearing base 2 comprises a side wall 21 and a lower surface 23. Further, the bearing base 2 is formed with a round hole 24 with the axis line X as its center for carrying the output shaft 4, a hollow chamber 8 for receiving a stop member 7 therein and circumferential grooves 9 for engaging with convex ribs 63 formed on the inner surface of the shield 6. The hollow chamber 8 is preferably formed on the lower surface 23 of the bearing base, so that the output shaft 4 can pass through the round hole 24 and the hollow chamber 8. Additionally, a side wall groove 10 is formed in the direction of the axis X on the side wall 21 of the bearing base 2, which communicates with the hollow chamber 8. The stop member 7 comprises a body 71 formed with a guiding side surface 76, a locking arm 72 on one side of the body 71 of the stop member, a support arm 75 on the other side of the body 71 of the stop member opposite to the locking arm 72, and an operation arm 73 connected to the locking arm 72. The locking arm 72 and the operation arm 73 may respectively be a single component connected to the body 71, and may also be formed integrally with the body 71. The body 71 of the stop member 7 is further formed with a through hole 74.

As shown in FIGS. 2 and 3, the hollow chamber 8 may accommodate the stop member 7, and the support arm 75 of the stop member 7 may receive an elastic component. In the present embodiment, the elastic component is a spring 11 with two ends thereof acting on the body 71 of the stop member and the side wall 21 of the bearing base, respectively. A support spacer 12 is fixedly mounted onto the lower surface 23 of the bearing base 2. The support spacer 12 enables the body 71 of the stop member to be stably mounted in the hollow chamber 8 with a predetermined sliding space. Further, a guiding surface 81 is formed within the hollow chamber 8 for cooperating with the guiding side surface 76 so that the body 71 of the stop member may slide along the guiding surface 81 in the hollow chamber 8. When the body 71 of the stop member is slidably mounted in the chamber 8, the locking arm 72 and the operation arm 73 are positioned within the side wall groove 10. When the spring 11 is in its natural state, the body 71 of the stop member is pushed by the spring 11 to slide in the hollow chamber 8, thus the locking arm 72 protrudes out of the side wall groove 10 and engages with the groove 62 so as to lock the shield 6. When the shield 6 is needed to be changed in position by the operator, the operation arm 73 may be pushed to overcome the force of the spring 11, and then the body 71 of the stop member overcomes the spring force so as to slide in the hollow chamber 8 and, as a result, the locking arm 72 disengages from the groove 62 of the shield 6 so that the shield 6 can be rotated to another appropriate position. Then, the operation arm 73 is released and the locking arm 72 engages with the groove 62 of the shield 6 again so as to lock the shield 6.

As shown in FIGS. 5, 6, 7, 8, 10 and 12, another embodiment of the shield-clamping device is illustrated. The bearing base 2*a* generally has a cylinder shape, and is fixedly connected via its upper end to the bottom of the housing 1*a* by screws. The bearing base 2*a* has a side wall 21*a* and a lower surface 23*a*. The bearing base 2*a* is formed with a round hole 24*a* with the axis line X as the center for carrying the output shaft 4*a*, a hollow chamber 8*a* for receiving a stop member 7*a* and a circumferential groove 9*a* for engaging the convex rib 63*a* formed on the inner surface of the shield 6*a*. The hollow chamber 8*a* is preferably formed on the lower surface 23*a* of the bearing base so that the output shaft 4*a* can pass through the hollow chamber 8*a*. The stop member 7*a* includes a body 71*a* formed with a guiding side surface 76*a*, a locking arm 72*a* on one side of the body 71*a* of the stop member, a support arm 75*a* on the other side of the body 71*a* of the stop member opposite to the locking arm 72*a*, and an operation arm 73*a* connected to the locking arm 72*a*. The locking arm 72*a* and the operation arm 73*a* may respectively be a single component connected to the body 71*a*, or may also be formed integrally with the body 71*a*.

As shown in FIGS. 5, 6, 7, 8, 10 and 12, the hollow chamber 8*a* accommodates the stop member 7*a*, and the support arm 75*a* of the stop member 7*a* receives an elastic component. In the present embodiment, the elastic component is a spring 11*a*, two ends of which act on the body 71*a* of the stop member and the side wall 21*a* of the bearing base respectively. A support spacer 12*a* is fixedly mounted onto the lower surface 23 of the bearing base 2 by a screw. The support spacer 12*a* ensures that the body 71*a* of the stop member may be stably mounted within the hollow chamber 8*a* with a predetermined sliding space. Additionally, a guiding surface 81*a* is formed in the hollow chamber 8*a* for mating with the guiding side surface 76*a* so that the body 71 of the stop member may slide in the hollow chamber 8*a* along the guiding surface 81*a*. When the body 71*a* of the stop member is slidably mounted within the chamber 8*a*, the locking arm 72*a* may preferably slide on the lower surface 23*a*, and may not contact the lower surface 23*a*. When the spring 11*a* is in its natural state, the body 71*a* of the stop member 71 may be pushed by the spring 11*a* to slide in the hollow chamber 8*a*, so that the locking arm 72*a* engages with the groove 62*a* so as to lock the shield 6*a*. When the shield 6*a* is needed to be changed in position by the operator, the operation arm 73*a* may be pushed by the operator to overcome the spring force of the spring 11*a*, then the body 71*a* of the stop member overcomes the spring force and slides in the hollow chamber 8*a*, as a result, the locking arm 72*a* disengages from the groove 62*a* of the shield 6*a* so that the shield 6*a* is rotated into another appropriate position. Then, the operation arm 73*a* is released and the locking arm 72*a* engages with the groove 62*a* of the shield 6*a* again so as to lock the shield 6*a*.

The contents explained above and shown in the drawings are exemplary embodiments of the present invention, and the protective scope of the invention should be defined by the claims. In this regard, it will be appreciated by those of ordinary skill in the art that certain of the elements described and illustrated in the drawing may be simply replaced with like elements and, as such, such modifications are also to be considered as falling within the protective scope of the present invention. For example, the concave groove of the locking element may be replaced by a convex arm, and the locking arm of the stop member may be replaced by a locking groove. Furthermore, magnets that repulse mutually may be arranged on the stop member and the bearing base respectively to replace the spring arranged between the stop member and the bearing base.

What is claimed is:

1. A power tool, comprising:

a housing accommodating a motor therein;

a bearing base having a lower surface and an upper end that is connected to the housing;

an output shaft mounted in the bearing base and protruding out of the lower surface of the bearing base;

a shield movably connected with the bearing base; and a locking mechanism for locking the shield relative to the bearing base, wherein the locking mechanism further comprises a locking element arranged on the shield and a stop member and wherein the bearing base is formed with a hollow chamber within which the stop member is arranged, wherein the hollow chamber is formed with a guiding surface, and the stop member is formed with a guiding side surface and slidably mounted within the hollow chamber, wherein a support spacer is mounted on the lower surface of the bearing base, wherein the stop member is further formed with an operation arm and a locking arm, and wherein the bearing base further comprises a side wall formed with a side groove which communicates with the hollow chamber in the lower surface, and at least one of the operation arm or the locking arm passes through the side groove of the side wall.

2. The power tool according to claim 1, wherein the locking element arranged on the shield is a groove which engages with the locking arm.

3. The power tool according to claim 1, wherein an elastic component is arranged between the stop member and the bearing base and wherein one end of the elastic component acts on the stop member and a second end of the elastic component acts on the bearing base.

4. The power tool according to claim 3, wherein the elastic component comprises a spring.

5. The power tool according to claim 1, wherein cooperative disposed magnets are arranged between the stop member and the bearing base with a first one of the magnets mounted to the stop member and a second one of the magnets mounted to the bearing base.

6. The power tool according to claim 1, wherein the hollow chamber is formed on the lower surface of the bearing base.

* * * * *